US005382376A

United States Patent [19]

Michael et al.

[11] Patent Number: 5,382,376

[45] Date of Patent: Jan. 17, 1995

[54] HARD SURFACE DETERGENT COMPOSITIONS

[75] Inventors: Daniel W. Michael, Cincinnati; Michael S. Maile, Maineville, both of Ohio

[73] Assignee: The Procter & Gamble Company, Cincinnati, Ohio

[21] Appl. No.: 105,702

[22] Filed: Aug. 17, 1993

Related U.S. Application Data

[63] Continuation-in-part of Ser. No. 955,610, Oct. 2, 1992, abandoned.

[51] Int. Cl.[6] ..... C11D 1/12; C11D 1/66; C11D 1/722; C11D 17/00

[52] U.S. Cl. ..... 252/153; 252/174.21; 252/170; 252/171; 252/121; 252/548; 252/158; 252/DIG. 10

[58] Field of Search ..... 252/174.21, 170, 171, 252/121, 548, 153, 158, DIG. 10

[56] References Cited

U.S. PATENT DOCUMENTS

| | | | |
|---|---|---|---|
| 3,592,774 | 7/1971 | Altenschopfer | 252/89 |
| 3,639,563 | 2/1972 | Januszewski | 424/49 |
| 3,882,038 | 5/1975 | Clayton et al. | 252/164 |
| 3,954,644 | 5/1976 | Krezanoski | 252/106 |
| 4,099,985 | 7/1978 | Garvin et al. | 134/4 |
| 4,396,521 | 8/1983 | Borrello | 252/118 |
| 4,443,364 | 4/1984 | Klinger et al. | 252/547 |
| 4,510,067 | 4/1985 | Ozmeral | 252/174.21 |
| 4,557,853 | 12/1985 | Collins | 252/128 |
| 4,581,161 | 4/1986 | Nedonchelle | 252/550 |
| 4,673,523 | 6/1987 | Smith et al. | 252/91 |
| 4,749,509 | 6/1988 | Kacher | 252/139 |
| 4,759,868 | 7/1988 | Clarke | 252/170 |
| 5,126,068 | 6/1992 | Burke et al. | 252/174.21 |
| 5,167,853 | 12/1992 | Stevens | 252/162 |
| 5,290,472 | 3/1994 | Michael | 252/170 |

FOREIGN PATENT DOCUMENTS

| | | | |
|---|---|---|---|
| 2004310 | 11/1990 | Canada | C11D 3/07 |
| 83223 | 7/1983 | European Pat. Off. | B01F 17/42 |
| 222557 | 5/1987 | European Pat. Off. | C11D 17/00 |
| 381618 | 8/1990 | European Pat. Off. | C11D 3/481 |
| 2166153 | 4/1986 | United Kingdom | C11D 3/44 |
| WO86/05510 | 9/1986 | WIPO | C11D 1/72 |

OTHER PUBLICATIONS

Hard Surface Cleaning: Using Surfactant and Polymer Technology in a Niche Market, Soap/Cosmetics/-Chemical Specialties, Sep. 1991, J. Burke et al.

A review of Block Polymer Surfactants, I. R. Schmolka, Mar. 1977, Journal of the American Oil Chemists' Society.

Technical Bulletin: Improvements in Glass Cleaner Technology, Aug. 14, 1992, BASF Corporation.

*Primary Examiner*—Glennon H. Hollrah
*Assistant Examiner*—Mary C. Cebulak
*Attorney, Agent, or Firm*—Robert B. Aylor

[57] ABSTRACT

Detergent compositions with excellent spotting/filming characteristics comprising propylene glycol/ethylene glycol block copolymer nonionic detergent surfactant, preferably in a surfactant mixture with a nonionic detergent surfactant having a conventional hydrocarbon hydrophobic group and a mixed propylene glycol/ethylene glycol hydrophilic group; optional hydrophobic cleaning solvent; and optional suds control system preferably comprising fatty acid and anionic sulfonated and/or sulfated detergent surfactant. The compositions are preferably in the form of aqueous liquids and preferably have monoethanolamine and/or beta-aminoalkanol present.

25 Claims, No Drawings

HARD SURFACE DETERGENT COMPOSITIONS

CROSS-REFERENCE TO RELATED APPLICATION

This is a continuation-in-part patent application of U.S. Ser. No. 07/955,610, filed Oct. 2, 1992, now abandoned.

FIELD OF THE INVENTION

This invention pertains to detergent compositions for hard surfaces. Such compositions typically contain detergent surfactants, detergent builders, and/or solvents to accomplish their cleaning tasks.

BACKGROUND OF THE INVENTION

The use of hard surface cleaning compositions containing organic water-soluble synthetic detergents, solvents, and, optionally, detergent builders are known. However, such compositions often have spotting/filming and/or sudsing characteristics that are not optimum.

An object of the present invention is to provide detergent compositions which provide (a) excellent spotting-/filming and/or (b) preferred sudsing characteristics.

SUMMARY OF THE INVENTION

This invention relates to hard surface detergent compositions with excellent spotting/filming characteristics comprising propylene glycol/ethylene glycol block copolymer nonionic detergent surfactant, preferably in a surfactant mixture with a nonionic detergent surfactant having a conventional hydrocarbon hydrophobic group and a mixed propylene glycol/ethylene glycol hydrophilic group; optional hydrophobic cleaning solvent; and optional suds control system preferably comprising fatty acid and synthetic anionic, preferably sulfonated and/or sulfated, detergent surfactant. Preferably the hard surface detergent composition, preferably aqueous, comprises: (a) nonionic detergent surfactant comprising more than 50% of a linear block copolymer which contains a hydrophobic portion consisting essentially of polypropylene glycol and at least one hydrophilic portion consisting essentially of polyethylene glycol, and the remainder of said nonionic detergent surfactant preferably consisting essentially of a linear mixed propylene glycol/ethylene glycol condensation product with a linear hydrophobic material wherein the glycols provide the hydrophilic portion of the surfactant; (b) the optional prefered, hydrophobic solvent that provides a primary cleaning function, is preferably at a level of less than about 6%; (c) the optional, but preferred, suds control system, comprises a low level of fatty acid and synthetic anionic detergent surfactant; and (d) the balance typically being an aqueous solvent system and minor ingredients, preferably color and/or perfume, said composition having a pH of from about 3 to about 12.5, preferably from about 6 to about 11.5, more preferably from about 7 to about 11. The composition can also contain, optionally, small amounts of additional surfactants and/or polycarboxylate detergent builders and/or buffering system (to maintain the desired pH). The compositions can be formulated either as concentrates, or at usage concentrations and can be packaged in a container having means for creating a spray to make application to hard surfaces more convenient. The product form should be one that is readily diluted with water, so solid compositions, such as sticks, are not useful.

DETAILED DESCRIPTION OF THE INVENTION

(a) The Nonionic Detergent Surfactant

In accordance with the present invention, it has been found that nonionic detergent surfactants which are block copolymers of propylene glycol and ethylene glycol, provide superior spotting/filming on hard surfaces.

The nonionic detergent surfactant which provides the main cleaning and emulsifying benefits herein is a block copolymer of propylene glycol and ethylene glycol having the formula:

$$R(EO)_n(PO)_m(EO)_nR$$

wherein EO is ethylene oxide, PO is propylene oxide, each n and m are selected to give a surfactant having a total molecular weight of from about 2,000 to about 8,000, preferably from about 3,000 to about 10,000, more preferably from about 4,000 to about 8,000, and each R being selected from hydrogen (preferred) and hydrocarbon groups, preferably $C_{1-4}$ hydrocarbon groups. These surfactants have an EO content of from about 20% to about 80%, preferably from about 20% to about 40%. Such surfactants typically have an HLB of from about 4 to about 30, preferably from about 7 to about 24, more preferably from about 7 to about 18. This nonionic detergent surfactant is very mild and provides good cleaning with exceptional spotting/filming characteristics.

The block copolymers which have a relatively high molecular weight hydrophobic group are preferred for solubilization of perfume and those with the low molecular weight hydrophobic groups are preferred for ease of biodegradability. In general, an EO content of from about 20% to about 40% is preferred for spotting/filming, especially for "full strength" use. However, for use of dilute solutions, the compounds with high molecular weight hydrophobic groups are acceptable with EO contents that are high, e.g., up to about 80%.

This block copolymer detergent surfactant is preferably at least about 20%, preferably at least about 50%, more preferably at least about 80%, of the total nonionic detergent surfactant present.

A preferred cosurfactant for use with the above block copolymer detergent surfactant has the formula:

$$R^1(EO)_n(PO)_mR$$

wherein $R^1$ is a hydrophobic moiety such as is derived from a fatty alcohol, fatty acid, fatty acid amide, etc., as is well known in the art, and n and m are integers selected to give a hydrophilic group, the EO and PO groups being present in any desired order in the chain, and EO, PO, and R having the meanings given hereinbefore. The HLB of this cosurfactant is from about 9 to about 14, preferably from about 11 to about 13. The amount of this cosurfactant present in the surfactant mixture is from 0% to about 50%, preferably from 0% to about 20%, more preferably from 0% to about 10%. This cosurfactant provides increased ability of the surfactant mixture to remove oily soils and to suspend perfumes, especially the desirable oily perfumes with less than about 1% solubility in water.

Other nonionic detergent surfactants useful herein at a low level, typically from 0% to about 40% of the total nonionic detergent surfactant present, include any of the well-known nonionic detergent surfactants that have an HLB of from about 6 to about 18, preferably from about 8 to about 16, more preferably from about 10 to about 15. Typical of these are alkoxylated (especially ethoxylated) alcohols and alkyl phenols, and the like, which are well-known from the detergency art. In general, such nonionic detergent surfactants contain an alkyl group in the $C_{8-22}$, preferably $C_{10-18}$, more preferably $C_{10-16}$, range and generally contain from about 2.5 to about 12, preferably from about 4 to about 10, more preferably from about 5 to about 8, ethylene oxide groups, to give an HLB of from about 8 to about 16, preferably from about 10 to about 14.

Specific examples of nonionic detergent surfactants useful herein include products sold by BASF under the names of Pluronic® and Plurafac®, i.e., Pluronics: F98, F108, F127, L62, L64, L72, L122, P65, P75, P84, P103, P104, P105, and P123 (block copolymers), and Plurafacs: RA20, RA30, D25, and B25-5 (cosurfactants). L indicates liquid, P indicates paste, and F indicates a flake solid.

A detailed listing of nonionic surfactants is found in U.S. Pat. No. 4,557,853, Collins, issued Dec. 10, 1985, incorporated by reference herein. Commercial sources of such surfactants can be found in McCutcheon's EMULSIFIERS AND DETERGENTS, North American Edition, 1984, McCutcheon Division, MC Publishing Company, also incorporated herein by reference.

The nonionic detergent surfactant typically comprises from 1% to about 15%, preferably from about 2% to about 10%, more preferably from about 2.5% to about 5% of the composition. At least 1% surfactant should be present to provide adequate cleaning.

(b) The Hydrophobic Solvent

In order to obtain good cleaning, especially of lipid soils, it is desirable to use a hydrophobic solvent that has cleaning activity. Preferably, however, the hydrophobic solvent is present at a level of less than about 5%, preferably less than about 4%, and a level of at least about 0.5%, preferably at least about 1%. The solvents employed in the hard surface cleaning compositions herein are some of the well-known "degreasing" solvents commonly used in, for example, the dry cleaning industry, in the hard surface cleaner industry and the metalworking industry. The level of hydrophobic solvent is typically from about 0.5% to about 6%, preferably from about 1% to about 4%, most preferably from about 2% to about 4%. The higher levels are used only when superior spotting/filming is not desired.

Such solvents typically are liquid at room temperature and readily volatile.

The formulator of compositions of the present type will be guided in the selection of solvent partly by the need to improve grease-cutting properties, and partly by aesthetic considerations. For example, kerosene hydrocarbons function quite well for grease cutting, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal sol vents.

Generically, the glycol ethers useful herein have the formula $$R^1O\text{-}(R^2O)_m\text{-}H$$

wherein each $R^1$ is an alkyl group, which contains from about 1 to about 8 carbon atoms, each $R^2$ is either ethylene or propylene, and m is a number from 1 to about 3, and the compound has a solubility in water of less than about 20%, preferably than about 10%, and more preferably less than about 6%. The must preferred glycol ethers for cleaning are selected from the group consisting of dipropyleneglycolmonobutyl ether, monopropyleneglycolmonobutyl ether, diethyleneglycolmonohexyl ether, monoethyleneglycolmonohexyl ether, and mixtures thereof. The most preferred glycol ethers for spotting/filming are tripropylene glycol and the $C_1$–$C_6$ alkyl ethers thereof, especially the monomethyl mono-butyl ethers.

The butoxy-propanol solvent should have no more than about 20%, preferably no more than about 10%, more preferably no more than about 7%, of the secondary isomer in which the butoxy group is attached to the secondary atom of the propanol for improved odor.

Such solvents also comprise diols having from 6 to about 16 carbon atoms in their molecular structure, especially diols having a solubility in water of from about 0.1 to about 20 g/100 g of water at 20° C.

Other solvents such as benzyl alcohol, n-hexanol, and phthalic acid esters of $C_{1-4}$ alcohols can also be used.

Terpene solvents and pine oil, are usable, but are preferably present only in small amounts since they are difficult to solubilize.

(c) The Suds Control System

The presence of a suds control system herein is highly preferred despite the low sudsing characteristics of the nonionic detergent surfactants. The preferred suds control system comprises fatty acid and anionic synthetic detergent surfactant.

(1) The Fatty Acid

The primary suds controlling ingredient is fatty acid containing from about 8 to about 22, preferably from about 10 to about 18, more preferably from about 10 to about 16, carbon atoms. Especially preferred fatty acids are derived from, e.g., coconut oil, palm kernel oil, and animal tallow.

The level of such fatty acid is from about 0.01% to about 0.3%, preferably from about 0.02% to about 0.20%, more preferably from about 0.02% to about 0.15%, for normal concentrations of nonionic detergent surfactant as set forth hereinbefore. Less fatty acid is needed for lower HLB nonionic detergent surfactants and more is needed for higher HLB nonionic detergent surfactants. Preferably the level of fatty acid is kept below about 0.1% in order to maintain superior spotting/filming performance. The ratio of nonionic detergent surfactant to fatty acid typically ranges from about 10:1 to about 120:1, preferably from about 20:1 to about 80:1.

The fatty acid does not control the suds of the nonionic detergent surfactant if it is used alone. Surprisingly, the fatty acid requires the presence of a small amount of anionic synthetic detergent surfactant, preferably a sulfonated or sulfated synthetic detergent surfactant, more preferably a sulfonated detergent surfactant as set forth hereinafter.

(2) The Anionic Sulfated or Sulfonated Detergent Surfactant

Typical synthetic, e.g., anionic sulfated and/or sulfonated detergent surfactants are the alkyl- and alkylethoxylate-(polyethoxylate) sulfates, paraffin sulfonates, alkyl benzene sulfonates, olefin sulfonates, alphaosulfonates of fatty acids and of fatty acid esters, and the like, which are well known from the detergency art. In general, such detergent surfactants contain an alkyl group in the $C_9$–$C_{22}$, preferably $C_{10}$–$C_{18}$, more preferably $C_{12}$–$C_{16}$, range. The anionic detergent surfactants can be used in the form of their sodium, potassium or alkanolammonium, e.g., triethanolammonium salts. $C_{12}$–$C_{18}$ paraffin-sulfonates and $C_9$–$C_{15}$ alkyl benzene sulfonates are especially preferred in the compositions of the present type. Although alkyl sulfates are not very efficient, alkyl ethoxylate sulfates are relatively efficient.

A detailed listing of suitable anionic detergent surfactants, of the above types, for the detergent compositions herein can be found in U.S. Pat. No. 4,557,853, Collins, issued Dec. 10, 1985, incorporated by reference hereinbefore. Commercial sources of such surfactants can be found in McCutcheon's EMULSIFIERS AND DETERGENTS, North American Edition, 1984, McCutcheon Division, MC Publishing Company, also incorporated hereinbefore by reference.

The anionic detergent cosurfactant component is typically present at a level of from about 0.1% to about 3.5%, more preferably from about 0.25% to about 1%. Anionic detergent surfactants are desirably present in limited amounts to promote rinsing of the surfaces. However, the level of synthetic anionic detergent surfactant should be less than about one half of the nonionic detergent surfactant.

It has been surprisingly found that the ratio of anionic surfactant to fatty acid is particularly critical in the control of sudsing. Preferably the ratio of anionic to fatty acid ranges from about 20:1 to about 3:1, more preferably the ratio lies between about 12:1 and about 4:1.

(d) Optional Monoethanolamine and/or Beta-aminoalkanol

Monoethanolamine and/or beta-aminoalkanol compounds serve primarily as solvents when the pH is above about 10, and especially above about 10.7. They also provide alkaline buffering capacity during use. Also, they do not hurt the spotting/filming properties of hard surface cleaning compositions. When perfumes that have a high percentage of terpenes are incorporated, the the beta-alkanolamines are often preferred, whereas the monoethanolamine is usually preferred.

Monoethanolamine and/or beta-alkanolamine, when present, are used at a level of from about 0.05% to about 10%, preferably from about 0.2% to about 5%. For dilute compositions they are typically present at a level of from about 0.05% to about 2%, preferably from about 0.1% to about 1%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable beta-aminoalkanols have the formula:

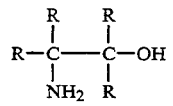

wherein each R is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino,1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The betaaminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

Polar solvents with only minimal cleaning action like methanol, ethanol, isopropanol, ethylene glycol, propylene glycol, and mixtures thereof are usually not present in large quantities. When the nonaqueous solvent is present, the level of nonaqueous polar solvent is preferably from about 0.5% to about 5% and the level of water is from about 50% to about 97%, preferably from about 75% to about 95%.

(e) Aesthetic Ingredients

Aesthetic-enhancing ingredients such as colorants and perfumes are usually present. Preferably they do not adversely impact on spotting/filming in the cleaning of glass (i.e. those that are more water-soluble and/or volatile). However, many consumers prefer perfumes that are relatively water insoluble.

Perfumes

Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. Perfume ingredients are difficult to solubilize in the compositions since the block copolymer nonionic surfactants will not solubilize much perfume, especially substantive perfume, or maintain uniformity to low temperatures.

The perfume ingredients and compositions of this invention are the conventional ones known in the art. Selection of any perfume component, or amount of perfume, is based solely aesthetic considerations. Suitable perfume compounds and compositions can be found in the art including U.S. Pat. Nos.: 4,145,184, Brain and Cummins, issued Mar. 20, 1979; 4,209,417, Whyte, issued June 24, 1980; 4,515,705, Moeddel, issued May 7, 1985; and 4,152,272, Young, issued May 1, 1979, all of said patents being incorporated herein by reference.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 or above, and are detectable at levels below those the average perfume material.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, cis-citral (neral), citronellal, citronellol, citronellyl acetate, paracymene, decanal, dihydrolinalool, dihydromyrcenol, dimethyl phenyl carbinol, eucalyptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, myrcene, myrcenyl acetate, myrcenoi, nerol, neryl acetate, nonyl acetate, phenyl ethyl alcohol, alpha-pinene, beta-pinene, gamma-terpinene, alpha-terpineol, beta-terpineol, terpinyl acetate, and vertenex (para-tertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, floracetate, heliotropine, 3-cis-hexenyl salicylate, hexyl salicylate, lilial (para-tertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other $C_{15}H_{24}$ sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclo-penta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-beta-naphthyl ketone, musk indanone, musk ketone, musk tibetene, and phenylethyl phenyl acetate.

Selection of any particular perfume ingredient is primarily dictated by aesthetic considerations, but more water-soluble materials are preferred, as stated hereinbefore, since such materials are less likely to adversely affect the good spotting/filming properties of the compositions.

(f) Optional Ingredients

The compositions herein can also contain very low levels of other various adjuncts which are known to the art for detergent compositions so long as they are not used at levels that cause unacceptable spotting/filming. Nonlimiting examples of such adjuncts are:

Very low levels of other detergent surfactants, e.g., zwitterionic detergent surfactants, and detergent builders;

Enzymes such as proteases; and

Hydrotropes such as sodium toluene sulfonate, sodium cumene sulfonate and potassium xylene sulfonate.

Zwitterionic Detergent Surfactants

Only low levels of zwitterionic detergent surfactants are present. Such surfactants contain both cationic and anionic hydrophilic groups on the same molecule at a relatively wide range of pH's. The typical cationic group is a quaternary ammonium group, although other positively charged groups like sulfonium and phosphonium groups can also be used. The typical anionic hydrophilic groups are carboxylates and sulfonates, although other groups like sulfates, phosphates, etc. can be used. A generic formula for some preferred zwitterionic detergent surfactants is:

$$R\text{-}N(+)(R^2)(R^3)R^4X(-)$$

wherein R is a hydrophobic group; $R^2$ and $R^3$ are each $C_{1-4}$ alky), hydroxy alkyl or other substituted alkyl group which can also be joined to form ring structures with the N; $R^4$ is a moiety joining the cationic nitrogen atom to the hydrophilic group and is typically an alkylene, hydroxy alkylene, or polyalkoxy group containing from about one to about four carbon atoms; and X is the hydrophilic group which is preferably a carboxylate or sulfonate group.

Preferred hydrophobic groups R are alkyl groups containing from about 8 to about 22, preferably less than about 18, more preferably less than about 16, carbon atoms. The hydrophobic group can contain unsaturation and/or substituents and/or linking groups such as aryl groups, amido groups, ester groups, etc. In general, the simple alkyl groups are preferred for cost and stability reasons.

A specific "simple" zwitterionic detergent surfactant is 3-(N-dodecyl-N,N-dimethyl)-2-hydroxy-propane-1-sulfonate, avail able from the Sherex Company under the trade name "Varion HC".

Other specific zwitterionic detergent surfactants have the generic formula:

$$R\text{-}C(O)\text{-}N(R^2)\text{-}(CR^3{}_2)n\text{-}N(R^2)_2(+)\text{-}(CR^3{}_2)_n\text{-}SO_3(-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR_{32}$) moiety. The R groups can be branched and/or unsaturated, and such structures can provide spotting/filming benefits, even when used as part of a mixture with straight chain alkyl R groups. The $R^2$ groups can also be connected to form ring structures. A detergent surfactant of this type is a $C_{10}$–$C_{14}$ fatty acylamidopropylene(hydroxypropylene)sulfobetaine that is available from the Sherex Company under the trade name "Varion CAS Sulfobetaine".

Other zwitterionic detergent surfactants useful herein include hydrocarbyl, e.g., fatty, amidoalkylenebetaines (hereinafter also referred to as "HAB"). These detergent surfactants have the generic formula:

$$R\text{-}C(O)\text{-}N(R^2)\text{-}(CR^3{}_2)_n\text{-}N(R^2)_2(+)\text{-}(CR^3{}_2)_n\text{-}C(O)O(-)$$

wherein each R is a hydrocarbon, e.g., an alkyl group containing from about 8 up to about 20, preferably up to about 18, more preferably up to about 16 carbon atoms, each ($R^2$) is either hydrogen or a short chain alkyl or substituted alkyl containing from one to about four carbon atoms, preferably groups selected from the group consisting of methyl, ethyl, propyl, hydroxy substituted ethyl or propyl and mixtures thereof, preferably methyl, each ($R^3$) is selected from the group consisting of hydrogen and hydroxy groups, and each n is a number from 1 to about 4, preferably from 2 to about 3; more preferably about 3, with no more than about one hydroxy group in any ($CR^3{}_2$) moiety. The R groups can be branched and/or unsaturated, and such-structures can provide spotting/filming benefits, even when used as part of a mixture with straight chain alkyl R groups.

An example of such a detergent surfactant is a $C_{10\text{-}14}$ acylamidopropylenebetaine available from the Miranol Company under the trade name "Mirataine BD".

The level of zwitterionic detergent surfactant in the composition is typically from 0% to about 0.5%, preferably from 0.02% to about 0.5%, more preferably from about 0.05% to about 0.25%.

Polycarboxylate Detergent Builders

Only low levels of polycarboxylate detergent builders can be present. Such builders include the builders disclosed in U.S. Pat. No. 4,915,854, Mao et al., issued Apr. 10, 1990, and incorporated herein by reference. Suitable detergent builders preferably have relatively strong binding constants for calcium. Preferred detergent builders include citrates and, especially, builders whose acids have the generic formula:

$$R^5\text{-}[O\text{-}CH(COOH)CH(COOH)]_nR^5$$

wherein each $R^5$ is selected from the group consisting of H and OH and n is a number from about 2 to about 3 on the average. Other preferred detergent builders include those described in U.S. Pat. 5,051,573 of Stephen Culshaw and Eddy Vos for "Hard-Surface Cleaning Compositions," issued Sep. 24, 1991, said patent being incorporated herein by reference.

In addition to the above detergent builders, other detergent builders that are relatively efficient for hard surface cleaners and/or, preferably, have relatively reduced filming/streaking characteristics include those disclosed in. U.S. Pat. No. 4,769,172, Siklosi, issued Sep. 6, 1988, and incorporated herein by reference.

The chelating agents of the invention, when they are present, are at levels of at least 0.5% to about 6% of the total composition, preferably about 1% to about 5%, more preferably from about 1% to about 4%.

The detergent builders can help provide the desired pH in use. However, if necessary, the composition can also contain additional buffering materials to give the desired pH in use. pH is usually measured on the product.

The compositions of this invention are preferably substantially free of materials that will adversely affect spotting/filming. Additionally, the compositions should not contain large amounts of materials that have no function. Examples of such materials include: degraded starch materials; sugar; solvents such as chloroform, short chain alcohols, glycols, etc.; sanitizers like quaternary ammonium and/or iodophor bacteriacides; etc.

These compositions have exceptionally good spotting/filming properties. They also have good "shine" properties, i.e., when used to clean glossy surfaces, without rinsing, they have much less tendency than e.g., phosphate built products to leave a dull finish on the surface.

The product can be packaged in a container that comprises a means for creating a spray, e.g., a pump, aerosol propellant and spray valve, etc.

All parts, percentages, and ratios herein are "by weight" unless otherwise stated. All numerical values are approximations unless otherwise stated.

The invention is illustrated by the following Examples.

| Example No.: Ingredient | 1 Wt. % | 2 Wt. % | 3 Wt. % | 4 Wt. % | 5 Wt. % |
|---|---|---|---|---|---|
| Pluronic ® P123 | 3.5 | — | — | — | 3.5 |
| Pluronic ® F127 | — | 3.5 | — | — | — |
| Pluronic ® P103 | — | — | 3.5 | — | — |
| Pluronic ® F108 | — | — | — | 3.5 | — |
| Tripropylene Glycol Monomethyl Ether | 1.0 | 1.0 | 1.0 | 1.0 | 1.0 |
| Secondary Alkane Sulfonate | — | 0.3 | — | 0.3 | 0.2 |
| Coconut Fatty Acid | — | 0.03 | — | 0.03 | — |
| Hydrophobic Perfume* | 0.2 | 0.1 | 0.2 | 0.1 | 0.3 |
| Pontamine Bond Blue A (0.02% in water) | 0.7 | 0.7 | 0.7 | 0.7 | 0.7 |
| D&C Yellow #10 (0.01% in water) | 0.2 | 0.2 | 0.2 | 0.2 | 0.2 |
| Deionized Water | q.s. | q.s. | q.s. | q.s. | q.s. |

*Hydrophobic perfume consists mainly Of terpenes, terpene alcohols, and other materials with citrus type character.

| Example No.: Ingredient | 6 Wt. % | 7 Wt. % |
|---|---|---|
| Pluronic ® L-62 | 3.5 | 3.5 |
| Plurafac ® RA-30 | 0.5 | 0.5 |
| Secondary Alkane Sulfonate | 0.3 | 0.2 |
| Coconut Fatty Acid | 0.03 | 0.02 |
| Tripropylene Glycol Monomethyl Ether | — | 1.0 |
| Monoethanolamine | — | 0.5 |
| Hydrophobic Perfume* | 0.2 | 0.2 |
| Pontamine Bond Blue A (0.02% in water) | 0.7 | 0.7 |
| D&C Yellow #10 | 0.2 | 0.2 |

-continued

| Example No.: Ingredient | 6 Wt. % | 7 Wt. % |
|---|---|---|
| (0.01% in water) Deionized Water | q.s. | q.s. |

*Hydrophobic perfume consists mainly of terpenes, terpene alcohols, and other materials with citrus type character.

What is claimed is:

1. A hard surface detergent composition with excellent spotting/filming characteristics comprising propylene glycol/ethylene glycol block copolymer nonionic detergent surfactant; optional hydrophobic cleaning solvent that provides a cleaning function; optional suds control system; minor ingredient selected from the group consisting of color, perfume, and mixtures thereof; and, optionally, an aqueous solvent system, the pH of said composition being from about 3 to about 12.5, the level of nonionic detergent surfactant being at least 1% and not more than about 15%, the level of hydrophobic solvent, when present, being from about 0.5% to about 6%, any optional polycarboxylate builder, when present, being at a level of at least 0.5%, and said composition not being in stick form.

2. The composition of claim 1 containing a suds control system comprising fatty acid and synthetic anionic detergent surfactant.

3. The composition of claim 2 wherein said anionic detergent surfactant is selected from the group consisting of paraffin sulfonates, alkyl benzene sulfonates, and alkyl ethoxylate sulfates.

4. The composition of claim 2 containing from about 1% to about 5% of said hydrophobic cleaning solvent, said solvent having a solubility in water of less than about 20%.

5. The composition of claim 4 wherein said hydrophobic cleaning solvent is selected from the group consisting of: benzyl alcohol, glycol ethers, and mixtures thereof.

6. The composition of claim 5 wherein said hydrophobic clearing solvent has the formula $$R^1O(R^2O)_mH$$

wherein each $R^1$ is an alkyl group which contains from about 4 to about 8 carbon atoms, each $R^2$ is selected from the group consisting of ethylene or propylene, and m is a number from 1 to about 3.

7. The composition of claim 6 wherein said hydrophobic cleaning solvent is selected from the group consisting of dipropylene-glycolmonobutyl ether, monopropyleneglycolmonobutyl ether, diethyleneglycolmonohexyl ether, monoethyleneglycolmonohexyl ether, and mixtures thereof.

8. The composition of claim 2 additionally containing alkanolamine selected from the group consisting of monoethanolamine, beta-aminoalkanol, and mixtures thereof.

9. The composition of claim 8 wherein said alkanolamine comprises monoethanolamine.

10. The composition of claim 1 containing from about 1% to about 5% of said hydrophobic cleaning solvent, said solvent having a solubility in water of less than about 20%.

11. The composition of claim 10 wherein said hydrophobic cleaning solvent is selected from the group consisting of: benzyl alcohol, glycol ethers, and mixtures thereof.

12. The composition of claim 11 wherein said hydrophobic cleaning solvent has the formula $$R^1O(R^2O)_mH$$

wherein each $R^1$ is an alkyl group which contains from about 4 to about 8 carbon atoms, each $R^2$ is selected from the group consisting of ethylene or propylene, and m is a number from 1 to about 3.

13. The composition of claim 12 wherein said hydrophobic cleaning solvent is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

14. The composition of claim 1 wherein the level of said nonionic detergent surfactant is from about 2% to about 10%; the level of said hydrophobic solvent is from about 1% to about 5%; and the pH of said composition is from about 8.5 to about 11.5.

15. The composition of claim 1 containing as an additional ingredient a nonionic detergent surfactant having a conventional hydrocarbon hydrophobic group and a mixed propylene glycol/ethylene glycol hydrophilic group.

16. The composition of claim 15 wherein said nonionic detergent surfactant has an HLB of from about 9 to about 14.

17. The composition of claim 15 containing a suds control system comprising fatty acid and synthetic anionic detergent surfactant.

18. The composition of claim 17 wherein said anionic detergent surfactant is selected from the group consisting of paraffin sulfonates, alkyl benzene sulfonates, and alkyl ethoxylate sulfates.

19. The composition of claim 15 containing from about 1% to about 5% of said hydrophobic cleaning solvent, said solvent having a solubility in water of less than about 20%.

20. The composition of claim 19 wherein said hydrophobic cleaning solvent is selected from the group consisting of: benzyl alcohol, glycol ethers, and mixtures thereof.

21. The composition of claim 20 wherein said hydrophobic cleaning solvent has the formula $$R^1O(R^2O)_mH$$

wherein each $R^1$ is an alkyl group which contains from about 4 to about 8 carbon atoms, each $R^2$ is selected from the group consisting of ethylene or propylene, and m is a number from 1 to about 3.

22. The composition of claim 21 wherein said hydrophobic cleaning solvent is selected from the group consisting of dipropyleneglycolmonobutyl ether, monopropyleneglycolmonobutyl ether, diethyleneglycolmonohexyl ether, monoethyleneglycolmonohexyl ether, and mixtures thereof.

23. The composition of claim 15 additionally containing alkanolamine selected from the group consisting of monoethanolamine. beta-aminoalkanol, and mixtures thereof.

24. The composition of claim 23 wherein said alkanolamine comprises monoethanolamine.

25. The process of cleaning hard surfaces comprising applying the composition of claim 1 to said surfaces.

* * * * *